US009291340B2

(12) United States Patent
Richardson

(10) Patent No.: US 9,291,340 B2
(45) Date of Patent: Mar. 22, 2016

(54) LIGHTING ASSEMBLY HAVING N-FOLD ROTATIONAL SYMMETRY

(71) Applicant: Rambus Delaware LLC, Brecksville, OH (US)

(72) Inventor: Brian Edward Richardson, Los Gatos, CA (US)

(73) Assignee: Rambus Delaware LLC, Brecksville, OH (US)

( * ) Notice: Subject to any disclaimer, the term of this patent is extended or adjusted under 35 U.S.C. 154(b) by 41 days.

(21) Appl. No.: 14/459,980

(22) Filed: Aug. 14, 2014

(65) Prior Publication Data

US 2015/0109780 A1 Apr. 23, 2015

Related U.S. Application Data

(60) Provisional application No. 61/894,701, filed on Oct. 23, 2013.

(51) Int. Cl.

| | |
|---|---|
| ***F21V 7/00*** | (2006.01) |
| ***F21V 29/70*** | (2015.01) |
| ***F21K 99/00*** | (2010.01) |
| *F21Y 101/02* | (2006.01) |
| *F21Y 105/00* | (2006.01) |
| *F21Y 111/00* | (2006.01) |

(52) U.S. Cl.

CPC . *F21V 29/70* (2015.01); *F21K 9/52* (2013.01); *F21V 7/0091* (2013.01); *F21Y 2101/02* (2013.01); *F21Y 2105/005* (2013.01); *F21Y 2111/001* (2013.01)

(58) Field of Classification Search

CPC ..... F21V 29/70; F21V 7/0091; F21K 9/52; F21Y 2105/005; F21Y 2111/001; F21Y 2101/02

See application file for complete search history.

(56) References Cited

U.S. PATENT DOCUMENTS

| | | | |
|---|---|---|---|
| 223,898 | A | 1/1880 | Edison |
| 2,673,923 | A | 3/1954 | Williams |
| 2,971,083 | A | 2/1961 | Phillips et al. |
| 4,171,874 | A | 10/1979 | Bigelow et al. |

(Continued)

FOREIGN PATENT DOCUMENTS

| | | |
|---|---|---|
| CN | 1701446 | 11/2005 |
| CN | 1147070 | 2/2010 |

(Continued)

*Primary Examiner* — Donald Raleigh

(74) *Attorney, Agent, or Firm* — Renner, Otto, Boisselle & Sklar, LLP

(57) ABSTRACT

A lighting assembly includes an LED light source assembly and a unitary light-transmissive solid reflector optical element. The reflector optical element has a light output surface and n light-transmissive solid optical sub-elements having n-fold rotationally symmetrical about a central axis. Boundaries between adjacent optical sub-elements extend radially outward from the central axis. Each optical sub-element has a reflective surface positioned opposite the light output surface on the optical sub-element and shaped to create an internal reflection effect. The LED light source assembly has an LED light source for each optical sub-element. The LED light sources are positioned along an outline near the light output surface to direct light from each LED light source towards the reflective surface of the respective optical sub-element such that the light is reflected by the reflective surface to form an output light that exits the reflector optical element through the light output surface.

16 Claims, 13 Drawing Sheets

(56) References Cited

U.S. PATENT DOCUMENTS

| | | | | |
|---|---|---|---|---|
| 4,172,631 | A | 10/1979 | Yevick | |
| 4,392,187 | A | 7/1983 | Bornhorst | |
| 4,420,796 | A | 12/1983 | Mori | |
| 4,431,966 | A | 2/1984 | Pucciarello | |
| 4,487,481 | A | 12/1984 | Suzawa | |
| 4,566,935 | A | 1/1986 | Hornbeck | |
| 4,596,992 | A | 6/1986 | Hornbeck | |
| 4,615,595 | A | 10/1986 | Hornbeck | |
| 4,618,216 | A | 10/1986 | Suzawa | |
| 4,662,746 | A | 5/1987 | Hornbeck | |
| 4,710,732 | A | 12/1987 | Hornbeck | |
| 4,737,896 | A | 4/1988 | Mochizuki et al. | |
| 4,936,659 | A | 6/1990 | Anderson et al. | |
| 4,956,619 | A | 9/1990 | Hornbeck | |
| 4,972,306 | A | 11/1990 | Bornhorst | |
| 4,974,122 | A | 11/1990 | Shaw | |
| 5,028,939 | A | 7/1991 | Hornbeck et al. | |
| 5,040,098 | A | 8/1991 | Tanaka et al. | |
| 5,046,826 | A | 9/1991 | Iwamoto et al. | |
| 5,057,974 | A | 10/1991 | Mizobe | |
| 5,083,252 | A | 1/1992 | McGuire | |
| 5,126,886 | A | 6/1992 | Richardson et al. | |
| 5,217,285 | A | 6/1993 | Sopori | |
| 5,221,987 | A | 6/1993 | Laughlin | |
| 5,319,491 | A | 6/1994 | Selbrede | |
| 5,359,691 | A | 10/1994 | Tai et al. | |
| 5,396,350 | A | 3/1995 | Beeson et al. | |
| 5,414,599 | A | 5/1995 | Kaneko et al. | |
| 5,467,208 | A | 11/1995 | Kokawa et al. | |
| 5,528,720 | A | 6/1996 | Winston et al. | |
| 5,631,895 | A | 5/1997 | Okada et al. | |
| 5,825,548 | A | 10/1998 | Bornhort et al. | |
| 5,936,772 | A | 8/1999 | Suzuki | |
| 5,953,469 | A | 9/1999 | Zhou | |
| 5,995,690 | A | 11/1999 | Kotz et al. | |
| 6,040,937 | A | 3/2000 | Miles | |
| 6,048,081 | A | 4/2000 | Richardson | |
| 6,167,182 | A | 12/2000 | Shinohara et al. | |
| 6,350,041 | B1 | 2/2002 | Tarsa et al. | |
| 6,360,033 | B1 | 3/2002 | Lee et al. | |
| 6,421,103 | B2 | 7/2002 | Yamaguchi | |
| 6,421,104 | B1 | 7/2002 | Richard | |
| 6,438,283 | B1 | 8/2002 | Karaguleff | |
| 6,502,961 | B1 | 1/2003 | Richardson | |
| 6,565,233 | B1 | 5/2003 | Richardson | |
| 6,674,562 | B1 | 1/2004 | Miles | |
| 6,729,734 | B2 | 5/2004 | Childers et al. | |
| 6,768,572 | B2 | 7/2004 | Romanovsky | |
| 6,771,325 | B1 | 8/2004 | Dewald et al. | |
| 6,824,270 | B2 | 11/2004 | Kim et al. | |
| 6,867,896 | B2 | 3/2005 | Miles | |
| 6,924,945 | B1 | 8/2005 | Richardson | |
| 6,971,781 | B2 | 12/2005 | Guy | |
| 6,974,232 | B1 | 12/2005 | Richardson | |
| 6,991,355 | B1 | 1/2006 | Coushaine et al. | |
| 7,080,932 | B2 | 7/2006 | Keuper | |
| 7,445,360 | B2 | 11/2008 | Ikeda | |
| 8,801,233 | B2 * | 8/2014 | Lu | F21V 5/002 362/249.02 |
| 8,974,060 | B2 * | 3/2015 | Plaian | A61B 3/12 351/206 |
| 2002/0031294 | A1 | 3/2002 | Takeda et al. | |
| 2002/0044720 | A1 | 4/2002 | Brophy et al. | |
| 2002/0105709 | A1 | 8/2002 | Whitehead et al. | |
| 2004/0076396 | A1 | 4/2004 | Suga | |
| 2004/0109105 | A1 | 6/2004 | Nagakubo et al. | |
| 2005/0018147 | A1 | 1/2005 | Lee et al. | |
| 2005/0057731 | A1 | 3/2005 | Lee et al. | |
| 2005/0201100 | A1 | 9/2005 | Cassarly et al. | |
| 2005/0207177 | A1 | 9/2005 | Guy | |
| 2005/0221473 | A1 | 10/2005 | Dubin et al. | |
| 2005/0243570 | A1 | 11/2005 | Chaves et al. | |
| 2005/0248827 | A1 | 11/2005 | Starkweather et al. | |
| 2005/0270796 | A1 | 12/2005 | Ichikawa et al. | |
| 2006/0070379 | A1 | 4/2006 | Starkweather et al. | |
| 2007/0133224 | A1 | 6/2007 | Parker | |
| 2007/0176887 | A1 | 8/2007 | Uehara et al. | |
| 2007/0211487 | A1 | 9/2007 | Sormani | |
| 2008/0170296 | A1 | 7/2008 | Chaves et al. | |
| 2008/0247169 | A1 | 10/2008 | Zou et al. | |
| 2009/0064993 | A1 | 3/2009 | Ghosh et al. | |
| 2009/0116099 | A1 | 5/2009 | Richardson | |
| 2009/0262368 | A1 | 10/2009 | Leong et al. | |
| 2010/0085773 | A1 | 4/2010 | Richardson | |
| 2010/0172138 | A1 | 7/2010 | Richardson | |
| 2010/0220492 | A1 | 9/2010 | Richardson | |
| 2010/0315802 | A1 | 12/2010 | Richardson | |
| 2010/0315836 | A1 | 12/2010 | Richardson | |
| 2010/0328748 | A1 | 12/2010 | Richardson | |
| 2011/0222309 | A1 | 9/2011 | Shinohara | |
| 2012/0099307 | A1 * | 4/2012 | Richardson | F21S 10/02 362/231 |
| 2012/0120676 | A1 | 5/2012 | Richardson | |
| 2012/0268930 | A1 * | 10/2012 | Lu | F21K 9/137 362/235 |

FOREIGN PATENT DOCUMENTS

| | | |
|---|---|---|
| CN | 101644386 | 2/2010 |
| DE | 102007030186 | 1/2009 |
| EP | 0814300 | 12/1997 |
| EP | 0867747 | 9/1998 |
| EP | 0969305 | 1/2000 |
| EP | 0969306 | 1/2000 |
| EP | 1215526 | 6/2002 |
| EP | 1291833 | 3/2003 |
| EP | 2045633 | 4/2009 |
| GB | 663840 | 12/1951 |
| JP | 10-041551 | 2/1998 |
| JP | 2000252525 | 9/2000 |
| JP | 2002223006 | 8/2002 |
| JP | 2002229017 | 8/2002 |
| JP | 2003115204 | 4/2003 |
| JP | 2006241249 | 9/2006 |
| JP | 2009087850 | 4/2009 |
| JP | 2009244693 | 10/2009 |
| JP | 2010123309 | 6/2010 |
| KR | 10-0972840 | 7/2010 |
| WO | 2004068183 | 8/2004 |
| WO | 2005071310 | 8/2005 |
| WO | 2007106020 | 9/2007 |
| WO | 2008060335 | 5/2008 |
| WO | 2009-024952 | 2/2009 |

* cited by examiner

LIGHTING ASSEMBLY HAVING N-FOLD ROTATIONAL SYMMETRY

RELATED APPLICATION DATA

This application claims the benefit of U.S. Provisional Patent Application No. 61/894,701, filed Oct. 23, 2013, the disclosure of which is incorporated herein by reference in its entirety.

BACKGROUND

Energy efficiency has become an area of interest for energy consuming devices. One class of energy consuming devices is lighting assemblies. Light emitting diodes (LEDs) show promise as energy efficient light sources for lighting assemblies. But light output distribution is an issue for lighting assemblies that use LEDs or similar light sources.

DESCRIPTION

Figure 1:
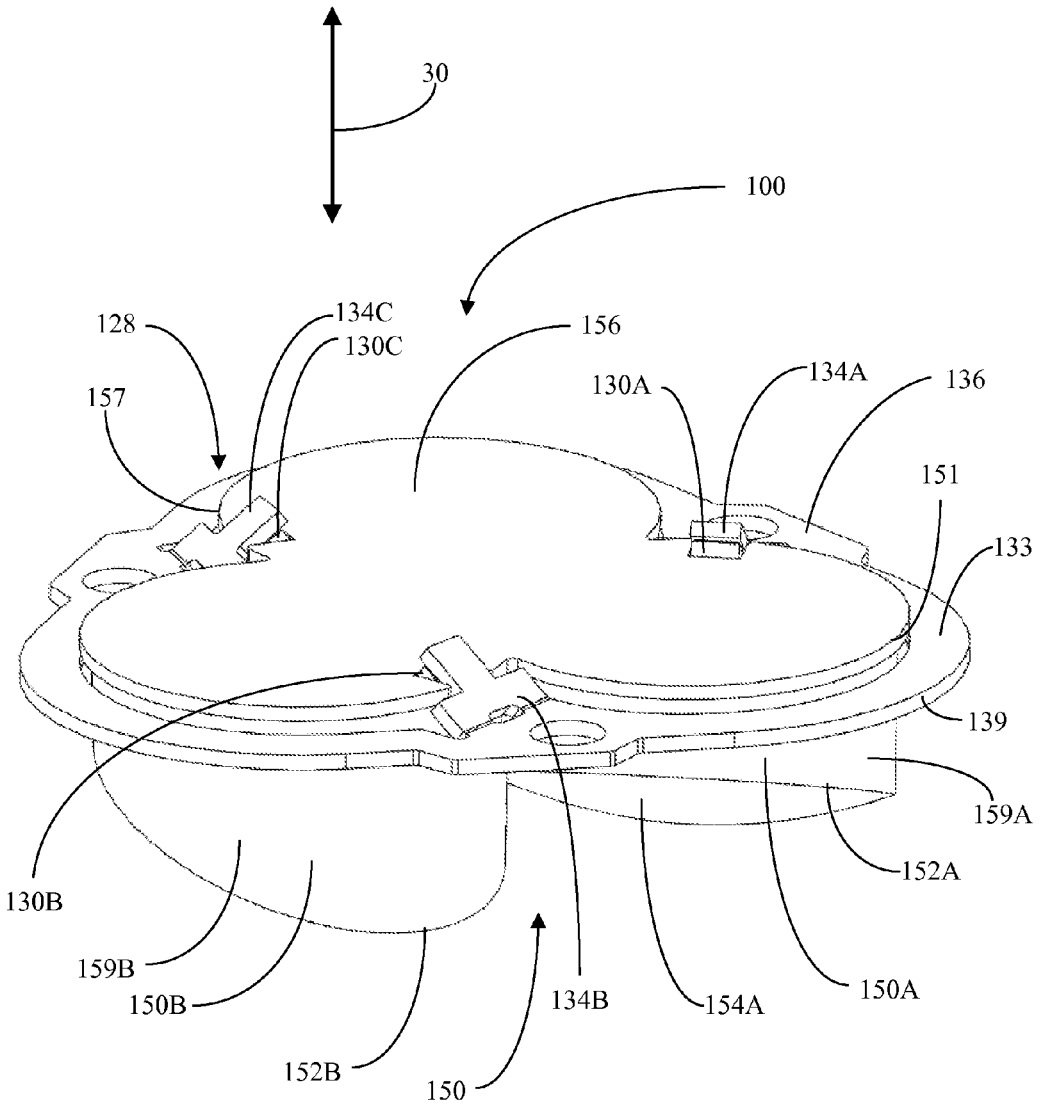
FIG. 1 is a schematic perspective view of an exemplary lighting assembly.

Embodiments will now be described with reference to the drawings, wherein like reference numerals are used to refer to like elements throughout. The figures are not necessarily to scale. Features that are described and/or illustrated with respect to one embodiment may be used in the same way or in a similar way in one or more other embodiments and/or in combination with or instead of the features of the other embodiments. In this disclosure, angles of incidence, reflection, and refraction and output angles are measured relative to the normal to the surface.

Figure 2:
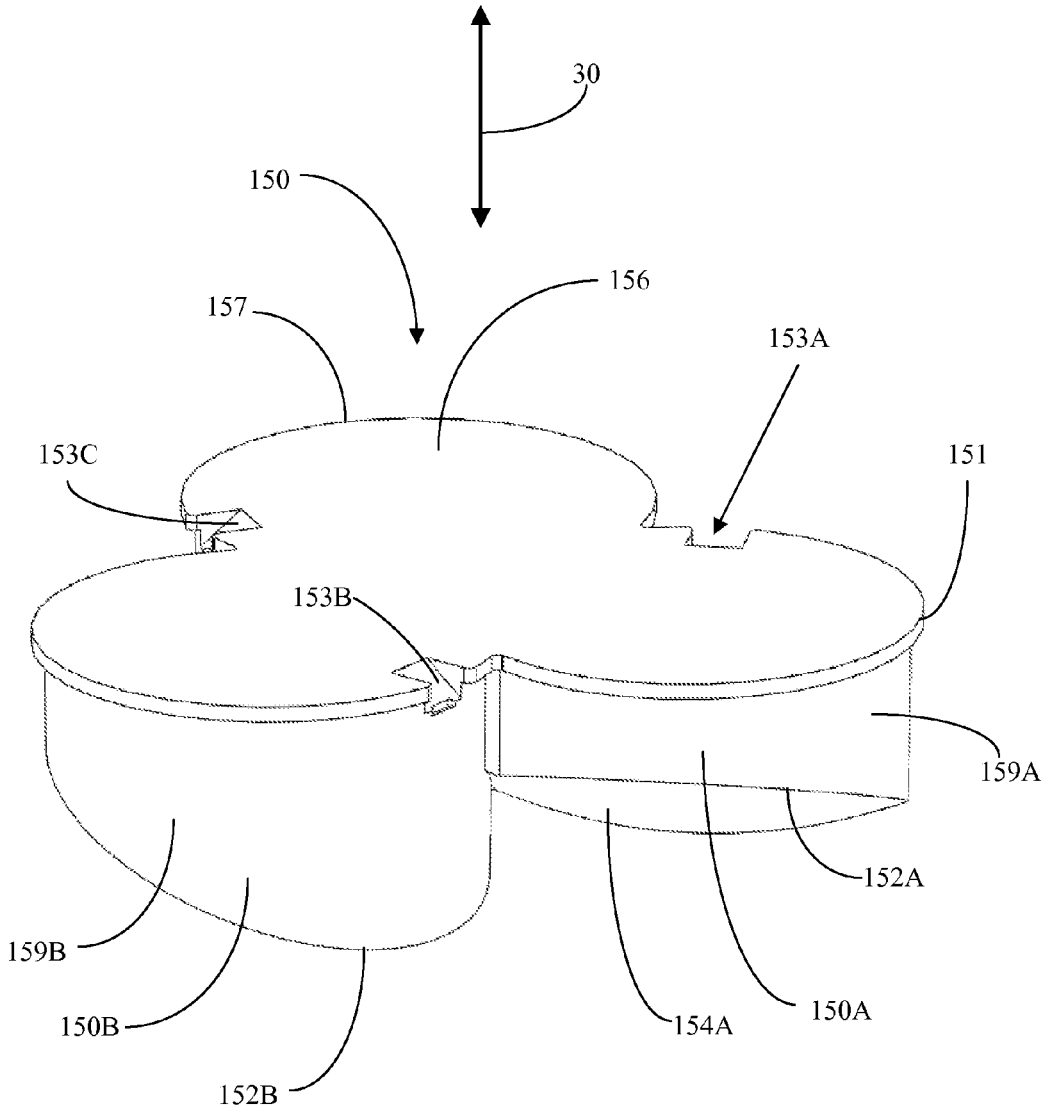
FIGS. 2 and 3 are schematic perspective views of the reflector optical element in the lighting assembly of FIG. 1.
Figure 3:
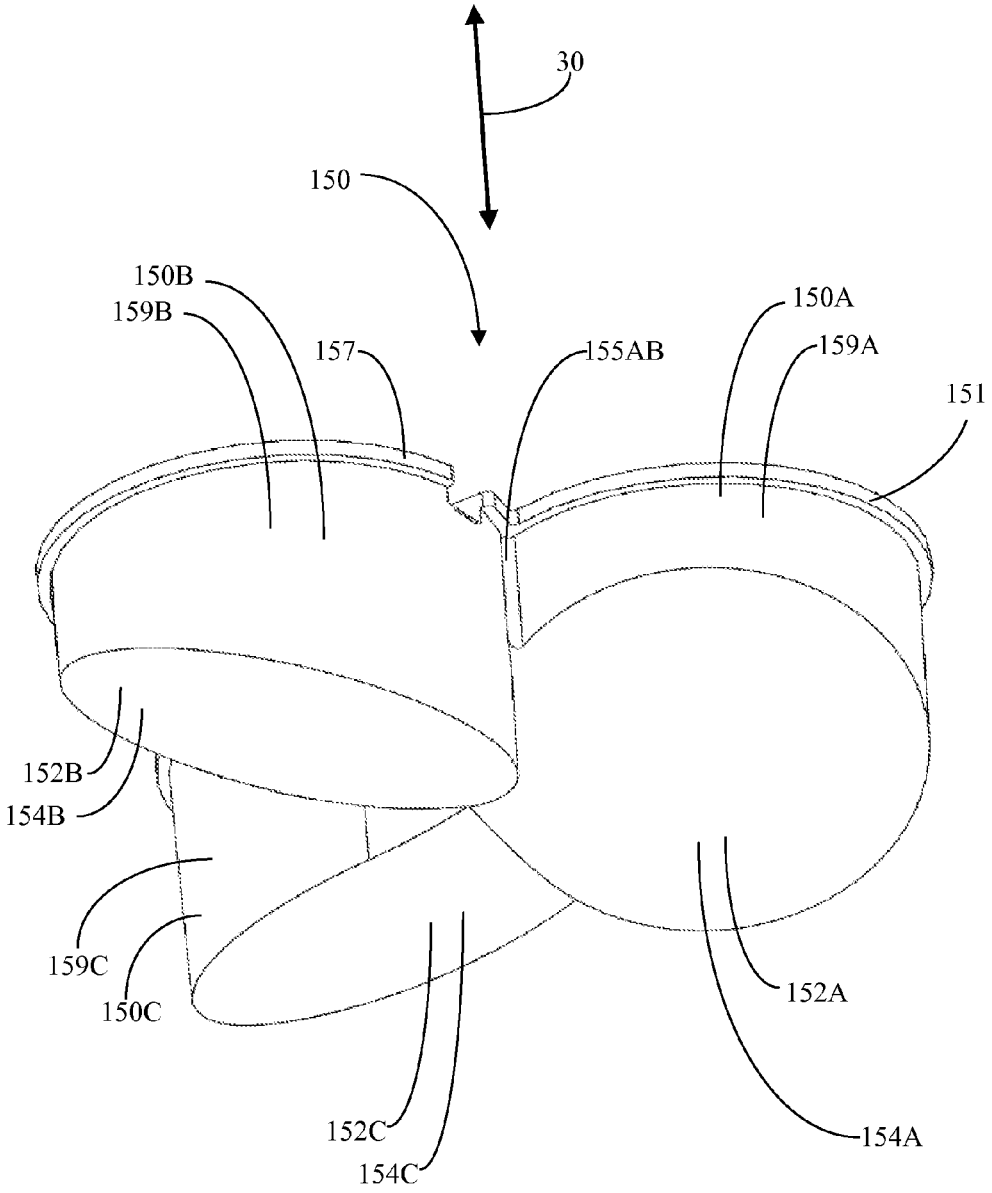
Figure 4:
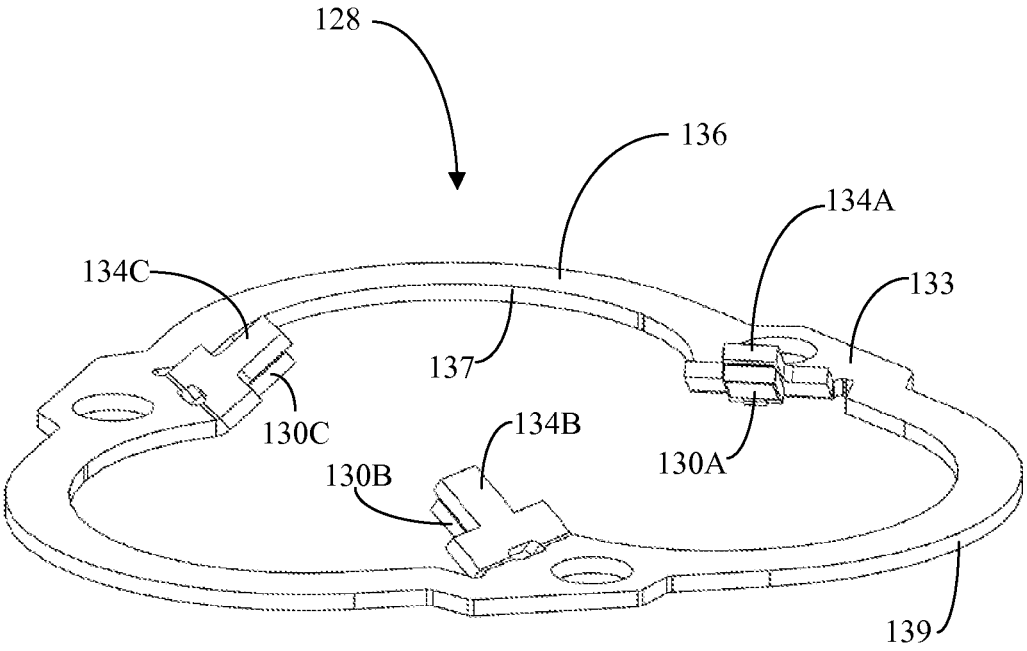
FIGS. 4 and 5 schematic perspective views of the light source assembly in the lighting assembly of FIG. 1.
Figure 5:
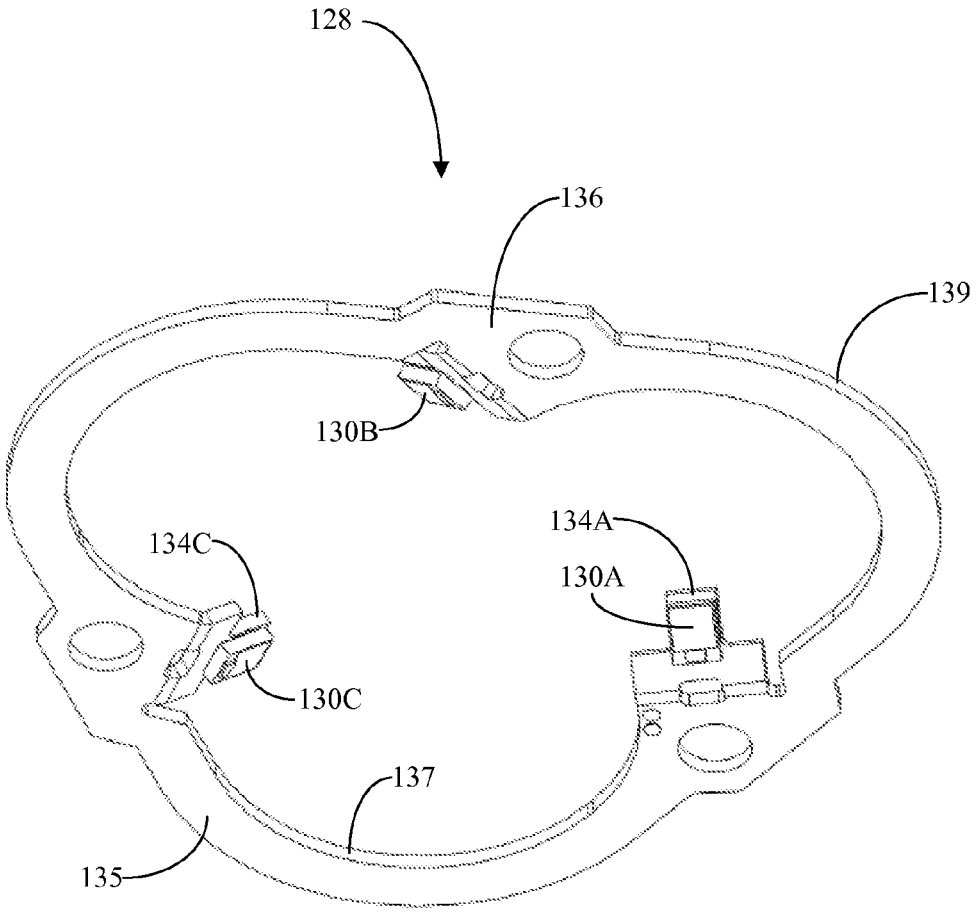
Figure 6:
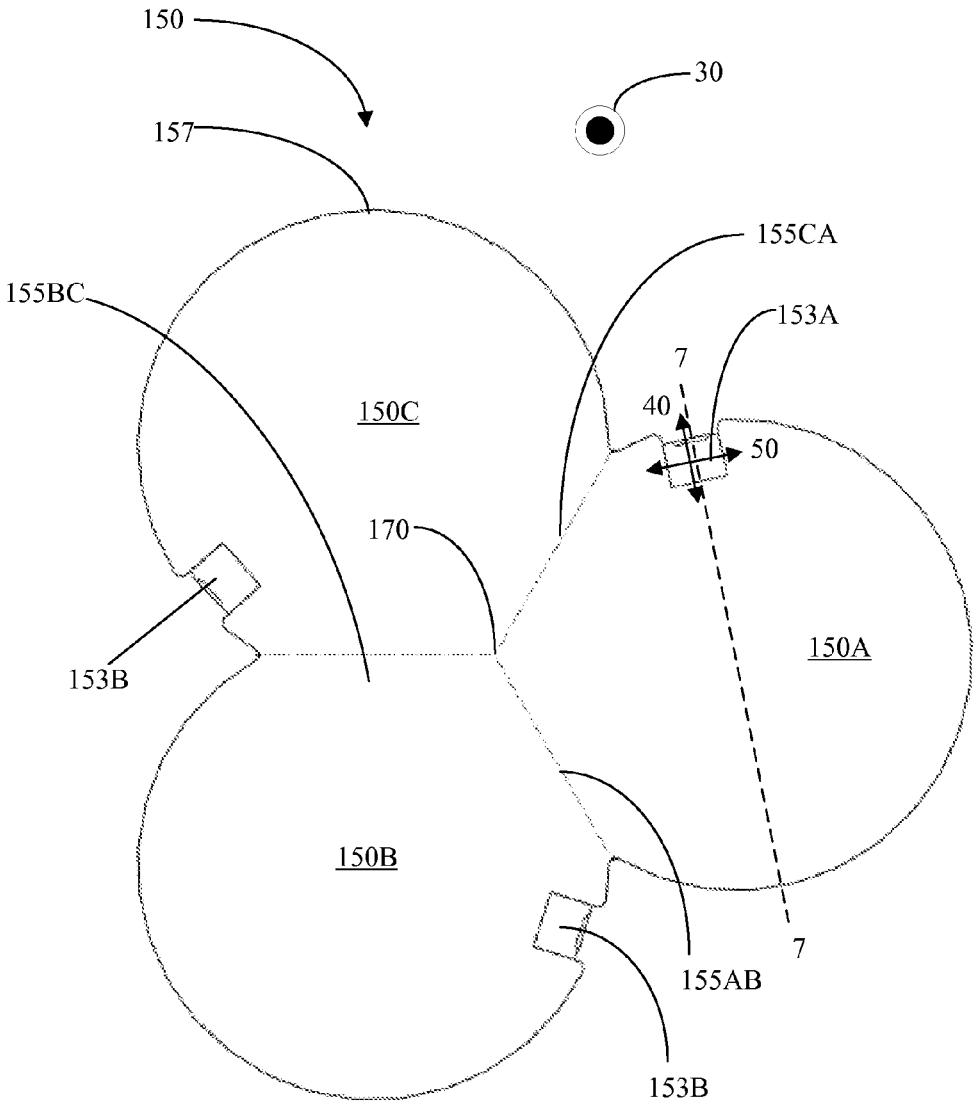
FIG. 6 is a schematic plan view of the reflector optical element of in the lighting assembly of FIG. 1.

An exemplary lighting assembly 100 will now be described with reference to FIGS. 1-7. FIG. 1 is a schematic perspective view of lighting assembly 100. Lighting assembly 100 has a reflector optical element 150 and a light source assembly 128. Reflector optical element 150 consists of three optical sub-elements 150A, 150B, and 150C although reflector optical element 150 has been fabricated as a unitary solid component. Reflector optical elements can be made where the number of optical sub-elements is different from three. FIGS. 2 and 3 are schematic perspective views of the reflector optical element 150 from two differing perspectives. Reflector optical element 150 includes a major surface (light output surface) 156 at its proximal end 151. In this example, the major surface 156 is substantially planar. Each of the optical sub-elements 150A, 150B, 150C, has a respective sidewall 159A, 159B, 159C extending from the proximal end 151 to the respective distal ends 152A, 152B, 152C. We define a central axis or axis of symmetry 170 (FIG. 6). The three sub-elements 150A, 150B, 150C are 3-fold symmetrical around the central axis 170. A direction parallel to the central axis 170 is called a longitudinal direction 30. The sidewalls 159A, 159B, 159C generally extend along the longitudinal direction 30. In this example, the light output surface 156 is perpendicular to the longitudinal direction 30. There is a converging reflective surface 154A, 154B, 154C located at the respective distal ends 152A, 152B, 152C. The sidewall 159A, 159B, 159C is collectively referred to as sidewall 159. Note that sidewall 159 includes a sidewall portion 157 at the proximal end 151 which also extends along the longitudinal direction 30 but has a slightly greater radial dimensions than the rest of the sidewall 159.

Lighting assembly 100 includes a light source assembly 128. The light source assembly 128 is shown from two differing perspectives in FIGS. 4 and 5. Solid-state light emitters 130A, 130B, and 130C are mounted to tilted circuit board elements 134A, 134B, and 134C, respectively. The tilted circuit board elements 134A, 134B, and 134C are connected to a circuit board 136. The circuit board 136 has a top major surface 133, a bottom major surface 135, an outer edge 139, and an inner edge 137 that faces toward and generally follows the contour of the sidewalls 159A, 159B, and 159C of the reflector optical element 150. The tilted circuit board elements 134A, 134B, and 134C are tilted with respect to the top major surface 133 or the bottom major surface 135 or both the top and bottom major surfaces 133, 135 of the circuit board 136. In the example shown, the circuit board 136 is configured as a metal core printed circuit board (MCPCB) and its major surfaces 133, 135 are parallel to the light output surface 156 and hence perpendicular to the longitudinal direction 30.

Light output from solid-state light emitter 130A, 130B, and 130C is input to optical sub-element 150A, 150B, and 150C, respectively. In the example shown, the solid-state light emitters 130A, 130B, and 130C are nominally identical to each other in output characteristics, including output spectrum, output angular distribution, and output luminance. In this example, each solid-state light emitter 130A, 130B, 130C is configured as a white LED and includes a light emitting diode (LED) die and a phosphor. A mixture of the phosphor and an encapsulant is positioned in a reflective cup to cover the LED die located at the bottom of the reflective cup. The LED die emits blue light and excites the photoluminescence of the phosphor. The combined output light of the solid-state light emitter is white light.

The solid-state light emitter 130A, 130B, 130C is positioned at the light input surface 153A, 153B, 153C, respectively. In an example, the solid-state light-emitter 130A, 130B, 130C is affixed to the light input surface 153A, 153B, 153C, using, for example, a suitable optical adhesive having a refractive index chosen to reduce Fresnel reflection losses as the light exits the solid state light emitter and enters the light input surface.

FIG. 6 is a schematic plan view of the reflector optical element 150, as viewed from the side of the light output surface 156. For ease of viewing, the light source assembly 128 has been removed. There is a boundary surface 155AB between adjacent optical sub-elements 150A and 150B, a boundary surface 155BC between adjacent optical sub-elements 150B and 150C, and boundary surface 155CA between adjacent optical sub-elements 150C and 150A. The boundary surfaces 155AB, 155BC, 155CA extend along the longitudinal direction 30 between the proximal end 151 and the distal ends 152A, 152B, 152C. The boundary surfaces 155AB, 155BC, and 155CA extend radially outward from a central axis (axis of symmetry) 170. The central axis 170 extends along the longitudinal direction 30. The three optical sub-elements are nominally identical to each other optical characteristics, and in combination with nominally identical solid-state light emitters 130A, 130B, and 130C, the lighting assembly 100 is three-fold symmetric around the axis of symmetry 170.

Figure 7:
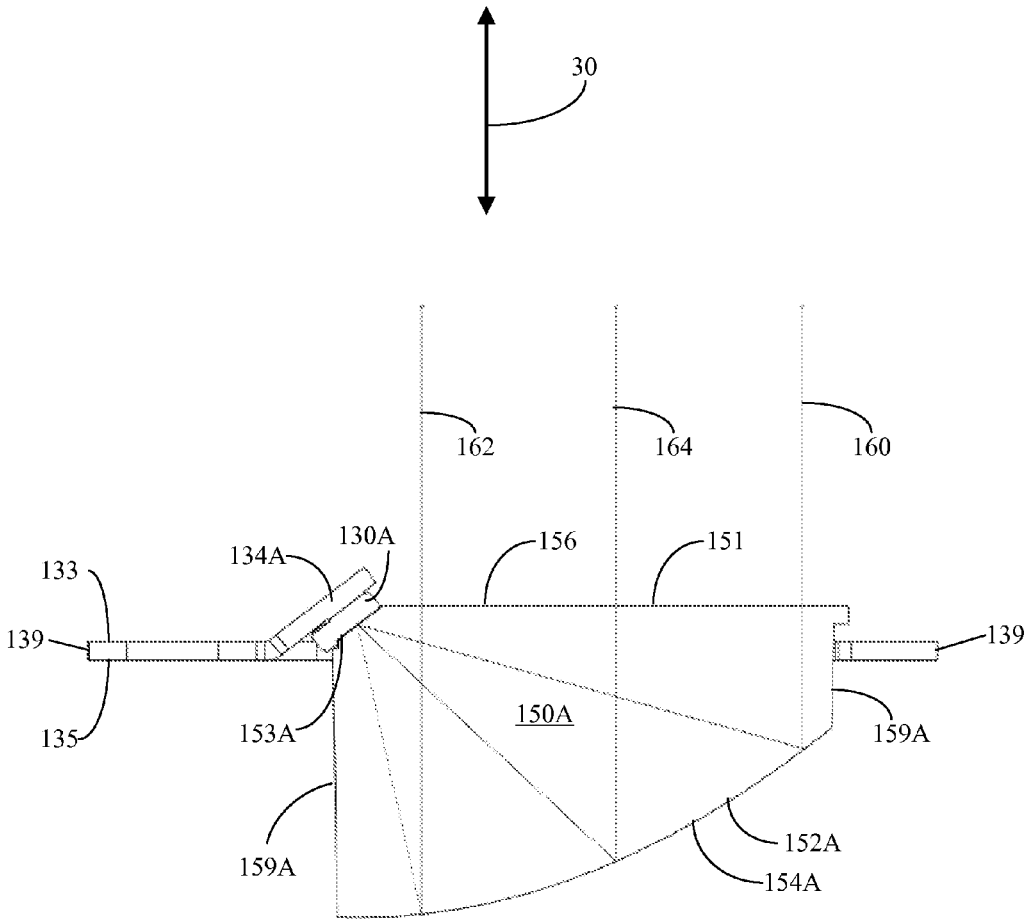
FIG. 7 is a cross-sectional view across a portion of the lighting assembly of FIG. 1.

In order to explain the propagation of light in the reflector optical element 150, we take a cross section across one of the optical sub-elements. The location of the cross section is shown as 7 in FIG. 6 and cuts across optical sub-element 150A and light input surface 153A. Additionally, while not shown in FIG. 6, the cross section is taken across solid-state light emitter 130A and respective portions of the light source assembly 128. A schematic cross-sectional view is shown in FIG. 7. Light from solid-state light emitter 130A enters the optical sub-element 150A through the light input surface 153A. Light input surface 153A is a substantially planar surface located at an intersection of the light output surface 156 and the sidewall 159 of reflector optical element 150. It is inclined (tilted) at an oblique angle to the light output surface 156. The light rays propagate in the optical sub-element within a cone angle ranging from approximately +42 degrees to approximately −42 degrees relative to the normal to the light input surface 153A. The actual range of angles depends on the refractive indices of the optical sub-element 150A and the material in optical contact with the light input surface 153A. In some cases, there is an air gap between the light input surface 153A and the solid-state light emitter 130A, so the material in optical contact with the light input surface 153A is air. In some other cases, there is an optical adhesive between the light input surface 153A and the solid-state light emitter 130A.

After entering the optical sub-element 150A through the light input surface 153A, the light propagates towards the reflective surface 154A located at the distal end 152A. In FIG. 7, three exemplary rays are shown: 160, 162, and 164. Light ray 164 is referred to as an on-axis ray that is relatively closer to the normal to the light input surface 153A than are off-axis rays 160 and 162. We refer to angles between the light output surface 156 and the normal to the light input surface as positive angles. Light ray 160 is an example of a positive angle light ray and light ray 162 is an example of a negative angle light ray. To produce the collimated output light beam, reflective surface 154A is parabolic in shape, or has a nearly parabolic shape designed by ray tracing. In other applications, reflective surface 154A can have other shapes, such as ellipsoidal and aspheric.

Since the light is incident on reflective surface 154A at relatively small angles of incidence, surface 154A is made reflective by a reflective coating applied to the surface. The reflective coating may be a silver coating, an aluminum coating, or a multilayer thin film dielectric coating. The selection of the appropriate coatings depends on the performance requirements of the application and cost considerations.

The light input surface 153A is angled non-parallel to light output surface 156 such that a normal to light input surface 153A at the location at which solid-state light emitter 130A is mounted intersects reflective surface 154A near the center of the reflective surface 154A. Furthermore, the reflective surface 154A is angled away from the longitudinal direction 30 and toward the light input surface 153A to increase the light incident on the reflective surface 154A.

Reflective surface 154A is tilted relative to the longitudinal direction 30 (or the normal to the light output surface of reflector optical element 150). In an example, the tilt of the reflective surface 154A is such that the angle between longitudinal direction 30 and the normal to the center of the reflective surface 154A is approximately one-half of the angle between the longitudinal direction 30 and the normal to light input surface 153A.

In a conventional design that lacks solid reflector optical element 150 of a high refractive index material, the light exiting solid-state light emitter 130A has a cone angle ranging from +90° to −90°. To reflect light with such a large cone angle would require a reflective surface substantially larger than reflective surface 154A within reflector optical element 150. This would make such conventional collimated light source impractically large for use in an application such as lighting assembly 100.

In the lighting assembly 100 of FIGS. 1-7, light output from each sub-element 150A, 150B, 150C is collimated along the longitudinal direction 30. The light exiting reflector optical element 150 through output surface 156 is minimally refracted as it exits reflective optic 150 through planar output surface 156. Furthermore, the total light output from the lighting assembly 100 is approximately three times the light output from each sub-element 150A, 150B, 150C. In some applications of lighting assembly 100, output surface 156 can be other than planar. Moreover, additional optics can be located downstream of output surface 156.

Figure 8:
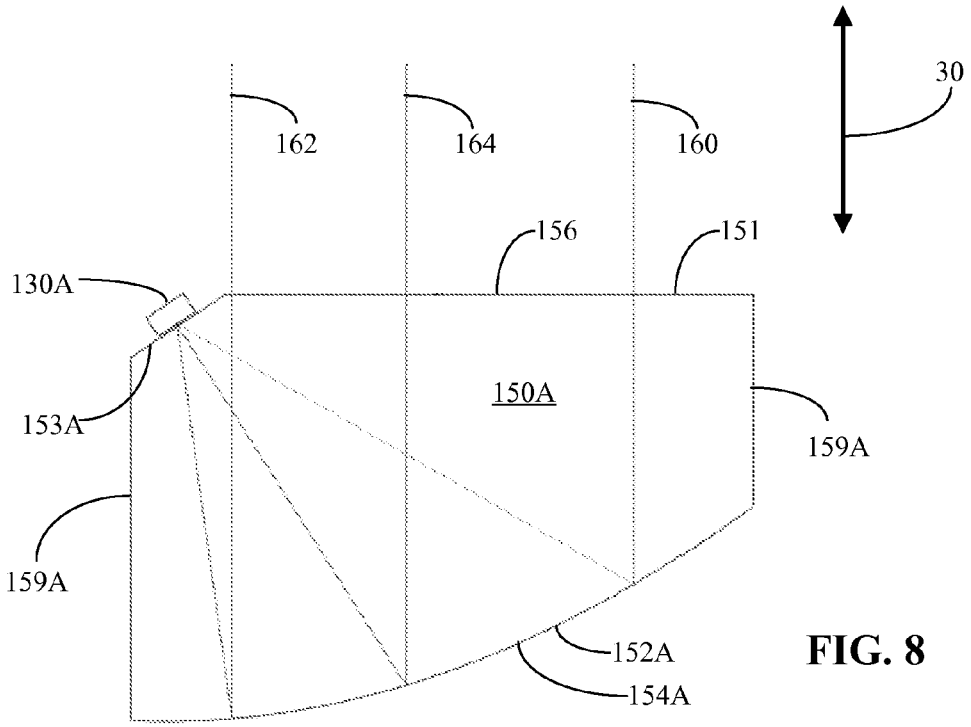
FIGS. 8-10 are cross-sectional views across a portion of other configurations of the lighting assembly of FIG. 1.
Figure 9:
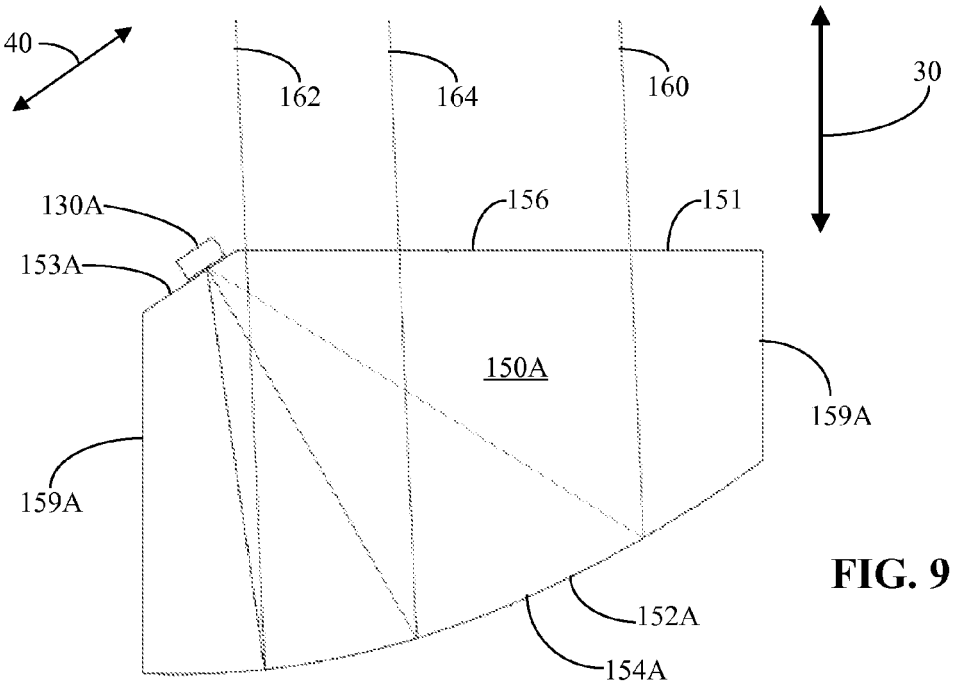
Figure 10:
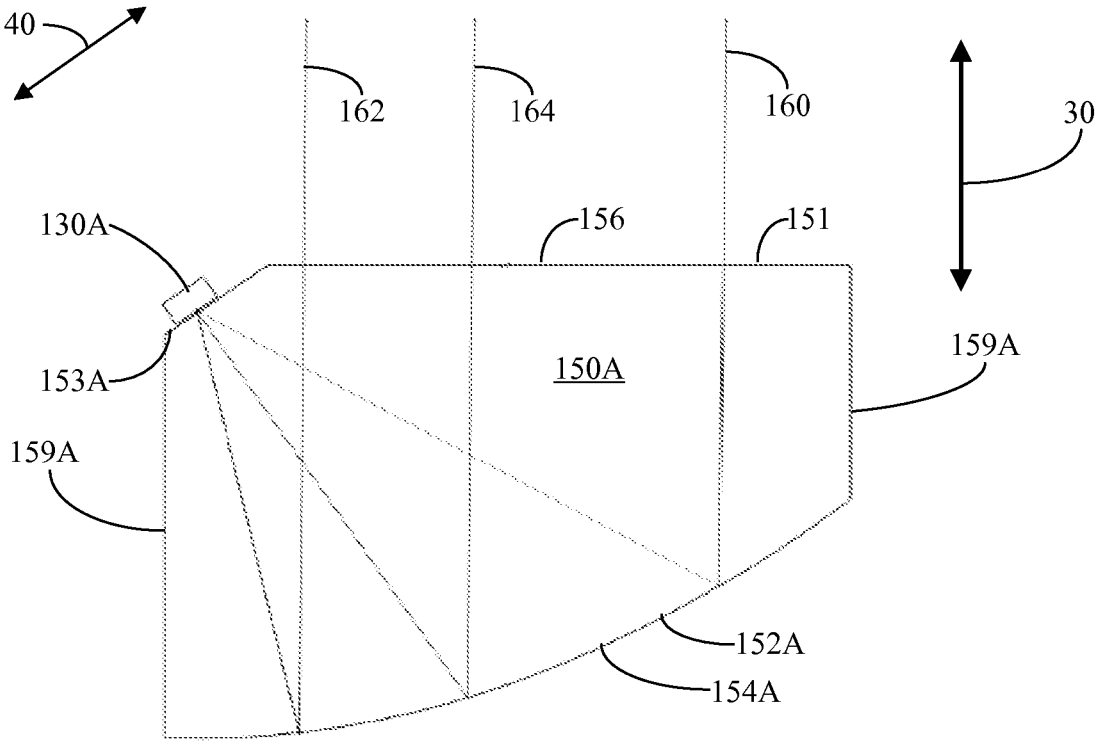

We discuss some variations in optical configuration with reference to FIGS. 8-10. In these figures the light source assembly 128 has been abbreviated with the exception of the solid-state light source 130A for ease of viewing. In FIG. 8, the solid-state light source 130A is positioned on light input surface 153A such that the light output from the sub-element is substantially parallel to longitudinal direction 30. Three exemplary light rays are shown: positive light ray 160, negative light ray 162, and light ray 164 that enters through the light input surface 153A normal thereto. All three light rays 160, 162, 164 are output through light output surface 156 parallel to longitudinal direction 30. Note that since the light entering the sub-element is confined to a range of approximately ±42 degrees, the sub-element can be configured such that the most of the light is not incident on the outer surface 159A and the boundary surfaces 150AB, 150CA.

In FIG. 9, the position of the solid-state light emitter 130A on the light input surface 153A has been moved away from the position in FIG. 8 towards the light output surface 156. This is along a direction 40, which is also shown in plan view in FIG. 6. As a result, the light rays 160, 162, 164 are tilted away from the longitudinal direction 30 toward the solid-state light emitter 130A (toward the light input surface 153A).

In FIG. 10, the position of the solid-state light emitter 130A on the light input surface 153A has been moved away from the position in FIG. 8 and away from the light output surface 156, along the direction 40. As a result, the light rays 160, 162, 164 are tilted away from the longitudinal direction 30 and away from the solid-state light emitter 130A (away from the light input surface 153A). The examples of FIGS. 9 and 10 show the cases of displacement of solid-state light emitter 130A on the light input surface 153A along the direction 40. Note from the plan view of FIG. 6 that displacement along other directions is also possible, for example a direction 50 on the light input surface 153A perpendicular to direction 40. Another possible direction is a direction radially outward from the central axis 170.

The three optical sub-elements 150A, 150B, 150C are three-fold symmetrical around the central axis 170. If a displacement of the solid-state light emitter 130A on the sub-element 150A (as illustrated for example in FIG. 9 or 10) were replicated for the solid-state light emitters 130B, 130C on respective sub-elements 150B, 150C, the resulting perturbations on the combined light output would also be three-fold symmetrical around the central axis. In this example, an output light beam that deviates from collimated output where the deviation is three-fold symmetrical about the central axis, can be obtained.

In the example of FIGS. 1-7, the solid-state light emitter 130 is optically coupled directly to the light input surface 153. This configuration presumes that the heat sink 134 is sufficiently small such that the light output is not obstructed. In other cases it may be necessary to displace the solid-state light emitter radially outwards from the light input surface 153 and provide a light pipe between the light input surface and the solid-state light emitter. An example of a lighting assembly that uses light pipes is explained below.

Figure 11:
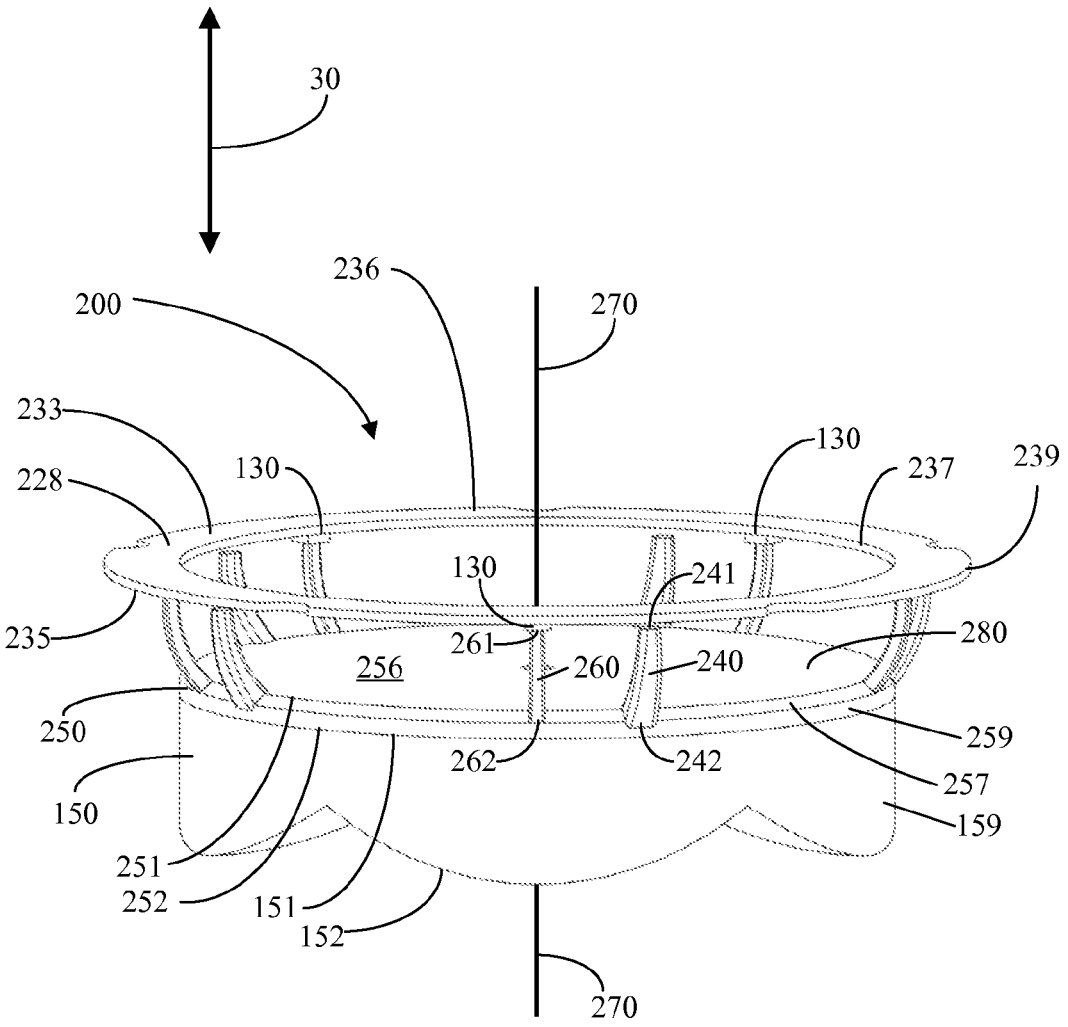
FIG. 11 is a schematic perspective view of another exemplary lighting assembly, in a first rotational position.
Figure 12:
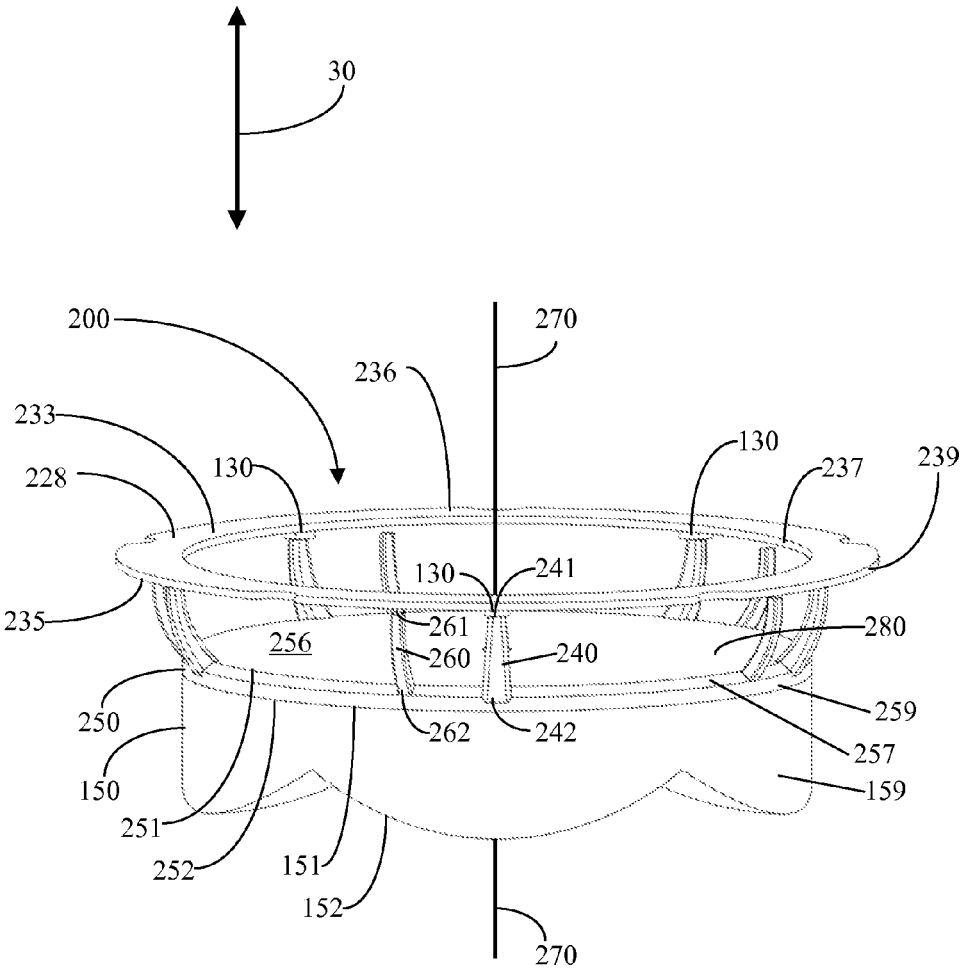
FIG. 12 is a schematic perspective view of the lighting assembly of FIG. 11, in a second rotational position.
Figure 13:
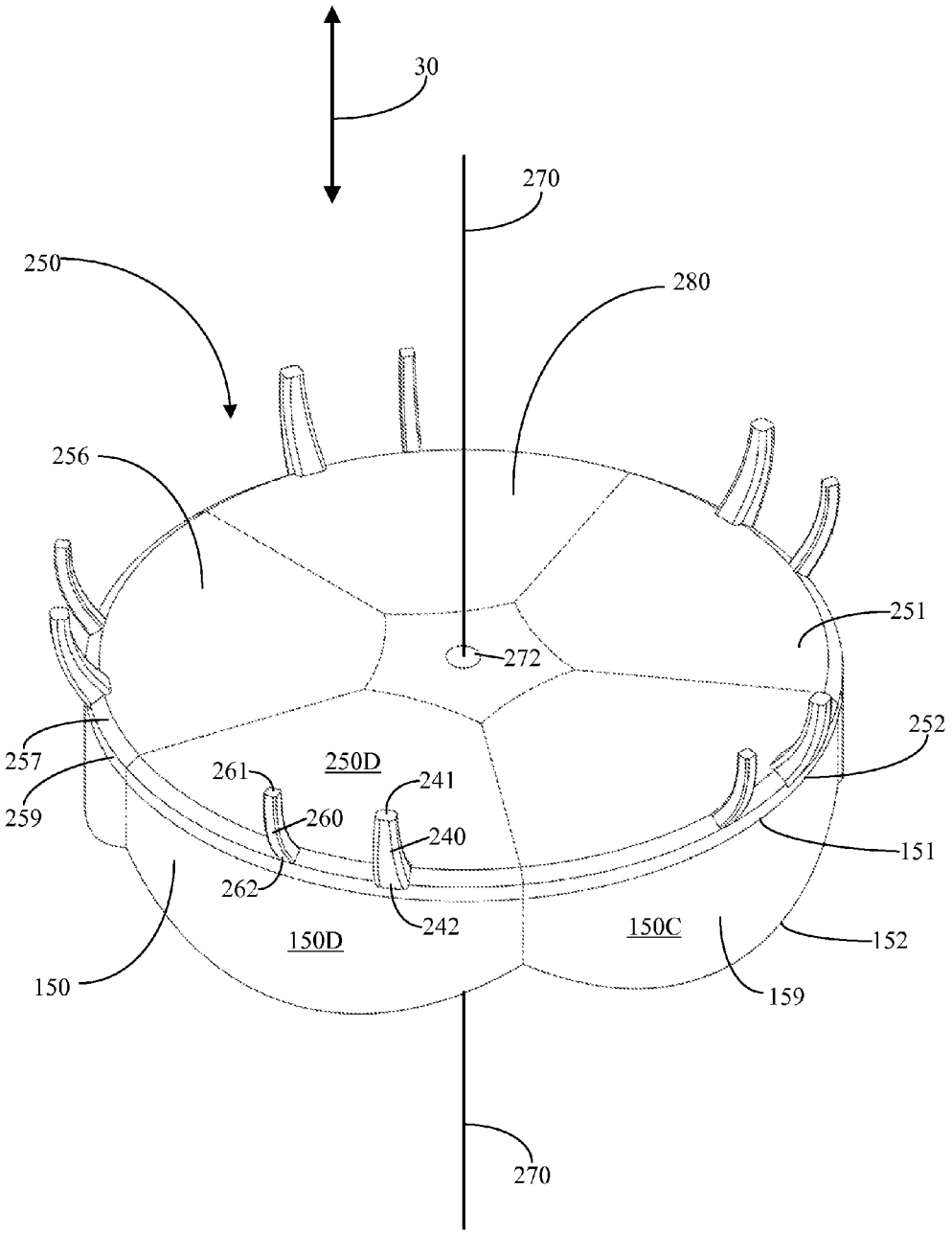
FIGS. 13 and 14 are schematic perspective views of the reflector optical element in the lighting assembly of FIG. 11.
Figure 14:
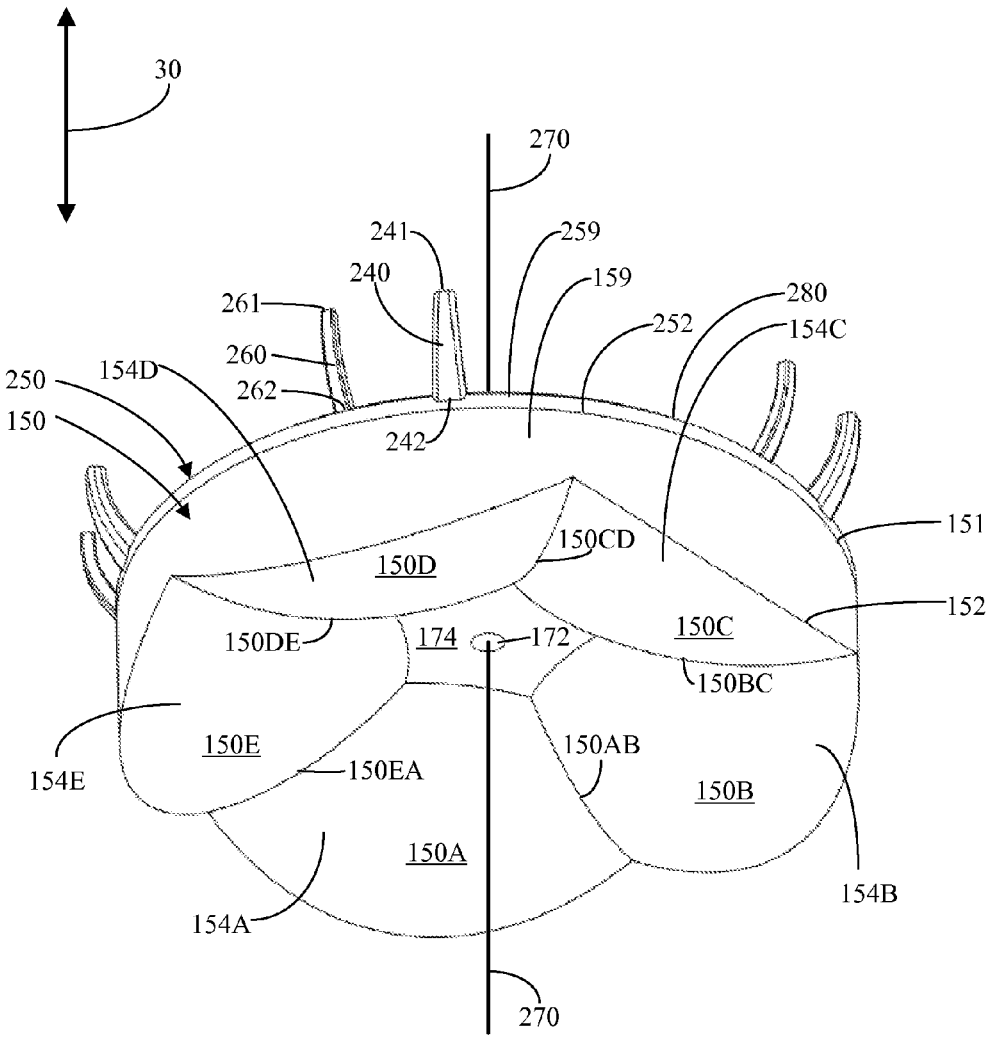

An adjustable lighting assembly 200 is explained with reference to FIGS. 11-14. The adjustability is achieved by rotation of an adjustable element 250 around the central axis 270. The two states corresponding to the rotation of the adjustable element 250 to its two positions is shown in FIGS. 11 and 12. Similar to lighting assembly 100, there is a reflector optical element 150. As can be seen in FIG. 14, in this example the reflector optical element 150 consists of 5 sub-elements 150A, 150B, 150C, 150D, and 150E, adjacent ones of the optical sub-elements being delineated by boundary surfaces 150AB, 150BC, 150CD, 150DE, and 150EA. Therefore, this lighting assembly 200 is 5-fold symmetrical around the central axis 270. Additionally, in this example the reflector optical element includes a central portion 174 not included in any of the sub-elements. There is a hole 172 in the middle of the reflector optical element (and hence in the middle of the central portion 174) through which a rod is positioned when the lighting assembly 200 is assembled. The hole 172 is located at the central axis 270.

The lighting assembly 200 additionally includes an adjustable element 250. The adjustable element 250 includes a disc-shaped element 280 that has two major surfaces 251, 252 parallel to each other and perpendicular to the longitudinal direction 30. In the center of the disc-shaped element 280 is a hole 272 located at the central axis 270. When the lighting assembly is fully assembled, the adjustable element 250 can be rotated around a rod that goes through the hole 272. Top major surface 251 functions as light output surface 256 of the adjustable element. The other major surface 252 is juxtaposed with the major surface 156 (light output surface) of the reflector optical element 150 through which light is output therefrom. Around the perimeter of the disc-shaped element 280 is an outer sidewall 259, extending substantially parallel to the longitudinal direction 30, and an angled wall 257 located between the outer sidewall 259 and the light output surface 256 (angled relative to the sidewall 259 and the major surfaces 251, 252).

The adjustable element 250 also has 5 pairs of light pipes 240, 260, where each pair of light pipes couples light to each of the sub-elements of the reflector optical element 150. Each light pipe 240, 260 has a light input end 241, 261 through which light from a solid-state light emitter enters the light pipe, and a light output end 242, 262 through which light is output from the light pipe. The light output ends 242, 262 are coupled to the disc-shaped element at the angled wall 257. The angled wall 257 is analogous to the light input surface 153A, 153B, 153C in the lighting assembly 100. The light exiting the light pipe propagates through disc-shaped element to the respective sub-element of the reflector optical element. The operation of the reflector optical element is as previously described with respect to lighting assembly 100.

In the example shown, the light pipes 240 and 260 differ in cross-sectional dimension. The light pipes 240 increase in cross-sectional dimension from the light input end 241 to the light output end 242. On the other hand the light pipes 260 stay substantially constant in cross-sectional dimension between the light input end 261 and the light output end 262. The light input end 261 of light pipe 260 and the light input end 241 of light pipe 240 are approximately equal in cross-sectional dimension. The light output end 262 of light pipe 260 is smaller in cross-sectional dimension than the light output end 242 of light pipe 240.

In the example shown in FIGS. 11 and 12, the light source assembly 228 includes a circuit board 236. The circuit board 236 has a top major surface 233, a bottom major surface 235 (facing toward the adjustable element), an outer edge 239, and an inner edge 237. The solid-state light emitters 130 are mounted onto the circuit board on the bottom major surface 235. In the example shown, the circuit board 236 is configured as a metal core printed circuit board (MCPCB) and its major surfaces 233, 235 are parallel to the light output surface 256 and hence perpendicular to the longitudinal direction 30.

The lighting assembly 200 can be operated in two rotational positions as shown in FIGS. 11 and 12. The adjustable member is rotated relative to the light source assembly 228 and the reflector optical element 150. The light source assembly 228 and reflector optical element 150 are fixed relative to each other. In a first rotational position (FIG. 11), the light output from the solid-state light emitters 130 enter the light pipes 260 and in a second rotational position (FIG. 12), the light output from the solid-state light emitters 130 enter the light pipes 240. The light entering the disc-shaped member has a greater cone angle in the first rotational position (FIG. 11) than in the second rotational position (FIG. 12) because the light enters the disc-shaped member from a light pipe of smaller cross-sectional dimension in first rotational position. Therefore, in this way the degree of collimation of the light output from the light output surface can be modified based on rotational position.

In some embodiments, the lighting assembly 100, 200 is a part of a lighting fixture, a sign, a light bulb (e.g., A-series LED lamp or PAR-type LED lamp), a portable lighting fixture (e.g., a flashlight) or an under-cabinet lighting fixture (e.g., lighting fixture for use under kitchen cabinets). For example, a flashlight with adjustable collimation can be made using lighting assembly 200.

In this disclosure, the phrase "one of" followed by a list is intended to mean the elements of the list in the alterative. For example, "one of A, B and C" means A or B or C. The phrase "at least one of" followed by a list is intended to mean one or more of the elements of the list in the alterative. For example, "at least one of A, B and C" means A or B or C or (A and B) or (A and C) or (B and C) or (A and B and C).

What is claimed is:

1. A lighting assembly, comprising:

an LED light source assembly; and a unitary light-transmissive solid reflector optical element comprising a light output surface, the reflector optical element having n light-transmissive solid optical sub-elements, n being an integer three or greater, the sub-elements being n-fold rotationally symmetrical about a central axis, boundaries between adjacent optical sub-elements extending radially outward from the central axis, each optical sub-element comprising a reflective surface positioned opposite the light output surface on the optical sub-element and shaped to create an internal reflection effect;

wherein the LED light source assembly comprises an LED light source for each optical sub-element, the LED light sources positioned along an outline near the light output surface radially outwards from the light output surface to direct light from each LED light source towards the reflective surface of the respective optical sub-element such that the light is reflected by the reflective surface to form an output light that exits the reflector optical element through the light output surface.

2. The lighting assembly of claim 1, wherein the LED light source assembly additionally comprises a thermally conductive circuit board on which the LED light sources are mounted, the circuit board having an opening to pass light from the light output surface.

3. The lighting assembly of claim 2, wherein the circuit board is substantially parallel to the light output surface except angled portions on which the LED light sources are mounted at oblique angles relative to the light output surface.

4. The lighting assembly of claim 2, wherein the LED light source assembly additionally comprises a heat sink thermally connected to the circuit board.

5. The lighting assembly of claim 1, wherein each reflective surface is curved towards the respective LED light source.

6. The lighting assembly of claim 1, wherein at least one of the reflective surfaces is parabolic.

7. The lighting assembly of claim 1, wherein at least one of the reflective surfaces is aspherical.

8. The lighting assembly of claim 1, wherein at least one of the reflective surfaces is elliptical.

9. The lighting assembly of claim 1, wherein at least one of the optical sub-elements comprises a light input surface adjacent an edge of, and non-parallel to, the light output surface; and the respective LED light source is mounted in optical contact with the light input surface.

10. The lighting assembly of claim 1, wherein the LED light sources are positioned adjacent an edge of the light output surface.

11. The lighting assembly of claim 1, wherein each optical sub-element additionally comprises a light pipe extending at least in part radially outward from the optical sub-element adjacent an edge of the light output surface and the respective LED light source is mounted in optical contact with a distal end of the light pipe, remote from the reflector optical element.

12. A flashlight comprising the lighting assembly of claim 1.

13. A lighting assembly, comprising:

an LED light source assembly;

a unitary light-transmissive solid reflector optical element comprising a first intermediate surface, the reflector optical element having n light-transmissive solid optical sub-elements, n being an integer three or greater, the sub-elements being n-fold rotationally symmetrical about a central axis, boundaries between adjacent optical sub-elements extending radially outward from the central axis, each optical sub-element comprising a reflective surface positioned opposite the first intermediate surface on the optical sub-element and shaped to create an internal reflection effect; and a unitary light-transmissive adjustable element comprising a light output surface and a second intermediate surface opposite the light output surface, the first intermediate surface and the second intermediate surface being juxtaposed to each other, the adjustable element being configured to be rotatable around the central axis to a first rotation position and a second rotational position relative to the reflector optical element;

wherein the LED light source assembly comprises an LED light source for each optical sub-element, the LED light sources positioned along an outline near the light output surface radially outwards from the light output surface, the light output from each LED light source entering the adjustable element at first regions on the adjustable element when the adjustable element is in the first rotational position, the light output from each LED light source entering the adjustable element at second regions on the adjustable element when the adjustable element is in the second rotational position, the light from the LED light sources propagating from each LED light source towards the reflective surface of the respective optical sub-element such that the light is reflected by the reflective surface to form an output light that exits the reflector optical element through the light output surface, the output light when the adjustable element is in the first rotational position differing from the output light when the adjustable element is in the second rotational position.

14. The lighting assembly of claim 13, additionally comprising a first light pipes for each of the sub-elements at the first regions and a second light pipe for each of the sub-elements at the second regions, wherein each of the first light pipes has a first input end receiving light from a respective one of the LED light sources when the adjustable element is in a first rotational position and a first output end in contact with the adjustable element at the first regions, and each of the second light pipes has a second input end receiving light from a respective one of the LED light sources when the adjustable element is in a second rotational position and a second output end in contact with the adjustable element at the second regions, the first light pipes being different from the second light pipes in cross-sectional dimension.

15. The lighting assembly of claim 13, wherein the output light when the adjustable element is in the first rotational position differs in degree of collimation from the output light when the adjustable element is in the second rotational position.

16. A flashlight comprising the lighting assembly of claim 13.

* * * * *